US007506698B2

(12) United States Patent
Eyre et al.

(10) Patent No.: US 7,506,698 B2
(45) Date of Patent: Mar. 24, 2009

(54) CUTTING ELEMENTS AND BITS INCORPORATING THE SAME

(75) Inventors: Ronald K. Eyre, Orem, UT (US); John L. Williams, Alpine, UT (US)

(73) Assignee: Smith International, Inc., Houston, TX (US)

( * ) Notice: Subject to any disclaimer, the term of this patent is extended or adjusted under 35 U.S.C. 154(b) by 137 days.

(21) Appl. No.: 11/513,292

(22) Filed: Aug. 29, 2006

(65) Prior Publication Data

US 2007/0175672 A1 Aug. 2, 2007

Related U.S. Application Data

(60) Provisional application No. 60/763,624, filed on Jan. 30, 2006.

(51) Int. Cl.
*E21B 10/46* (2006.01)

(52) U.S. Cl. ..... 175/57; 175/426

(58) Field of Classification Search ..... 175/426, 175/428, 432, 434, 57

See application file for complete search history.

(56) References Cited

U.S. PATENT DOCUMENTS 3,136,615 A 6/1964 Bovenkerk
3,141,746 A 7/1964 De Lai
3,233,988 A 2/1966 Wentorf, Jr. et al.
4,108,614 A 8/1978 Mitchell
4,151,686 A 5/1979 Lee et al.
4,224,380 A 9/1980 Bovenkerk et al.
4,255,165 A 3/1981 Dennis et al.
4,268,276 A 5/1981 Bovenkerk
4,288,248 A 9/1981 Bovenkerk et al.
4,311,490 A 1/1982 Bovenkerk et al.
4,373,593 A 2/1983 Phaal et al.
4,486,286 A 12/1984 Lewin et al.
4,504,519 A 3/1985 Zelez
4,522,633 A 6/1985 Dyer
4,556,403 A 12/1985 Almond et al.
4,604,106 A 8/1986 Hall et al.
4,605,343 A 8/1986 Hibbs, Jr. et al.
4,606,738 A 8/1986 Hayden
4,621,031 A 11/1986 Scruggs
4,645,977 A 2/1987 Kurokawa et al.
4,664,705 A 5/1987 Horton et al.
4,707,384 A 11/1987 Schachner et al.
4,766,040 A 8/1988 Hillert et al.
4,854,405 A 8/1989 Stroud
4,861,350 A 8/1989 Phaal et al.
4,871,377 A 10/1989 Frushour
4,899,922 A 2/1990 Slutz et al.

(Continued)

FOREIGN PATENT DOCUMENTS

EP 0329954 A2 8/1989

(Continued)

*Primary Examiner*—William P Neuder
(74) *Attorney, Agent, or Firm*—Christie, Parker & Hale, LLP.

(57) ABSTRACT

Cutting elements and bits incorporating such cutting elements are provided. The cutting elements have a substrate, a first ultra hard material layer formed over the substrate, and a second ultra hard material layer formed over the first ultra hard material layer. The second ultra hard material layer has a thickness in the range of 0.05 mm to 2 mm.

32 Claims, 8 Drawing Sheets

U.S. PATENT DOCUMENTS

| | | | | |
|---|---|---|---|---|
| 4,919,220 | A | 4/1990 | Fuller et al. | |
| 4,940,180 | A | 7/1990 | Martell | |
| 4,944,772 | A | 7/1990 | Cho | |
| 4,976,324 | A | 12/1990 | Tibbitts | |
| 5,011,514 | A | 4/1991 | Cho et al. | |
| 5,030,276 | A | 7/1991 | Sung et al. | |
| 5,127,923 | A | 7/1992 | Bunting et al. | |
| 5,135,061 | A | 8/1992 | Newton, Jr. | |
| 5,176,720 | A | 1/1993 | Martell et al. | |
| 5,337,844 | A | 8/1994 | Tibbitts | |
| 5,355,969 | A | 10/1994 | Hardy et al. | |
| 5,370,195 | A | 12/1994 | Keshavan et al. | |
| 5,379,853 | A | 1/1995 | Lockwood et al. | |
| 5,496,638 | A | 3/1996 | Waldenstrom et al. | |
| 5,510,193 | A | 4/1996 | Cerutti et al. | |
| 5,523,121 | A | 6/1996 | Anthony et al. | |
| 5,524,719 | A | 6/1996 | Dennis | |
| 5,667,028 | A | 9/1997 | Truax et al. | |
| 5,722,497 | A | 3/1998 | Gum et al. | |
| 5,722,499 | A | 3/1998 | Nguyen et al. | |
| 5,833,021 | A | 11/1998 | Mensa-Wilmot et al. | |
| 5,875,862 | A | 3/1999 | Jurewicz et al. | |
| 6,098,730 | A | 8/2000 | Scott et al. | |
| 6,193,001 | B1 * | 2/2001 | Eyre et al. | 175/432 |
| 6,248,447 | B1 | 6/2001 | Griffin et al. | |
| 6,315,065 | B1 | 11/2001 | Yong et al. | |
| 6,332,503 | B1 | 12/2001 | Pessier et al. | |
| 6,344,149 | B1 | 2/2002 | Oles | |
| 6,367,568 | B2 | 4/2002 | Steinke et al. | |
| 6,443,248 | B2 | 9/2002 | Yong et al. | |
| 6,550,556 | B2 | 4/2003 | Middlemiss et al. | |
| 6,601,662 | B2 | 8/2003 | Matthias et al. | |
| 6,892,836 | B1 * | 5/2005 | Eyre et al. | 175/432 |
| 6,904,984 | B1 | 6/2005 | Estes et al. | |
| 6,935,444 | B2 | 8/2005 | Lund et al. | |
| 6,991,049 | B2 | 1/2006 | Eyre et al. | |
| 2002/0071729 | A1 * | 6/2002 | Middlemiss et al. | 407/114 |
| 2006/0162969 | A1 * | 7/2006 | Belnap et al. | 175/433 |
| 2006/0266558 | A1 * | 11/2006 | Middlemiss et al. | 175/426 |
| 2007/0187155 | A1 * | 8/2007 | Middlemiss | 175/428 |

FOREIGN PATENT DOCUMENTS

| | | | |
|---|---|---|---|
| EP | 0500253 | A1 | 8/1992 |
| EP | 0617207 | A2 | 9/1994 |
| EP | 0787820 | A2 | 8/1997 |
| EP | 0860515 | A1 | 8/1998 |
| GB | 2323398 | A | 9/1998 |
| WO | WO 93/23204 | | 11/1993 |
| WO | WO 00/28106 | | 5/2000 |

* cited by examiner

CUTTING ELEMENTS AND BITS INCORPORATING THE SAME

CROSS REFERENCE TO RELATED APPLICATION

This application is based upon and claims priority on U.S. Provisional Application No. 60/763,624 filed on Jan. 30, 2006, the contents of which are fully incorporated herein be reference.

BACKGROUND OF THE INVENTION

Cutting elements used in rock bits or other cutting tools typically have a body (i.e., a substrate), which has a contact or interface face. An ultra hard material layer is bonded to the contact face of the body by a sintering process to form a cutting layer, i.e., the layer of the cutting element that is used for cutting. The substrate is generally made from tungsten carbide-cobalt (sometimes referred to simply as "cemented tungsten carbide," "tungsten carbide" "or carbide"), while the ultra hard material layer is a polycrystalline ultra hard material, such as polycrystalline diamond ("PCD"), polycrystalline cubic boron nitride ("PCBN") or thermally stable product ("TSP") material such as thermally stable polycrystalline diamond.

Cemented tungsten carbide is formed by carbide particles being dispensed in a cobalt matrix, i.e., tungsten carbide particles are cemented together with cobalt. To form the substrate, tungsten carbide particles and cobalt are mixed together and then heated to solidify. To form a cutting element having an ultra hard material layer such as a PCD or PCBN hard material layer, diamond or cubic boron nitride ("CBN") crystals are placed adjacent the cemented tungsten carbide body in a refractory metal enclosure (e.g., a niobium enclosure) and subjected to a high temperature and high pressures so that inter-crystalline bonding between the diamond or CBN crystals occurs forming a polycrystalline ultra hard material diamond or CBN layer. Generally, a catalyst or binder material is added to the diamond or CBN particles to assist in inter-crystalline bonding. The process of heating under high pressure is known as sintering. Metals such as cobalt, iron, nickel, manganese and alike an alloys of these metals have been used as a catalyst matrix material for the diamond or CBN. Various other materials have been added to the diamond crystals, tungsten carbide being one example.

The cemented tungsten carbide may be formed by mixing tungsten carbide particles with cobalt and then heating to form the substrate. In some instances, the substrate may be fully cured. In other instances, the substrate may be not fully cured, i.e., it may be green. In such case, the substrate may fully cure during the sintering process. In other embodiments, the substrate maybe in powder form and may solidify during the sintering process used to sinter the ultra hard material layer.

TSP is typically formed by "leaching" the cobalt from the diamond lattice structure of polycrystalline diamond. This type of TSP material is sometimes referred to as a "thermally enhanced" material. When formed, polycrystalline diamond comprises individual diamond crystals that are interconnected defining a lattice structure. Cobalt particles are often found within interstitial spaces in the diamond lattice structure. Cobalt has a significantly different coefficient of thermal expansion as compared to diamond, and as such, upon heating of the polycrystalline diamond, the cobalt expands, causing cracking to form in the lattice structure, resulting in the deterioration of the polycrystalline diamond layer. By removing, i.e., by leaching, the cobalt from the diamond lattice structure, the polycrystalline diamond layer because more heat resistant. In another exemplary embodiment, TSP material is formed by forming polycrystalline diamond with a thermally compatible silicon carbide binder instead of cobalt. "TSP" as used herein refers to either of the aforementioned types of TSP materials.

Due to the hostile environment that cutting elements typically operate, cutting elements having cutting layers with improved abrasion resistance, strength and fracture toughness are desired.

SUMMARY OF THE INVENTION

In one exemplary embodiment a cutting element is provided having a substrate, a first ultra hard material layer formed over the substrate, and a second ultra hard material layer formed over the first ultra hard material layer. The second ultra hard material layer has a thickness in the range of 0.05 mm to 2 mm. In an exemplary embodiment, the second ultra hard material layer has a higher abrasion resistance than the first ultra hard material layer. In another exemplary embodiment, the second ultra hard material layer has an average ultra hard material particle size that is smaller than an average ultra hard material particle size of the first ultra hard material layer. In yet a further exemplary embodiment, the second ultra hard material layer is a TSP material layer. In yet another exemplary embodiment, the second ultra hard material layer is a PCD material layer. In a further exemplary embodiment, the second ultra hard material layer is a PCBN material layer. In one exemplary embodiment, the second ultra hard material layer encapsulates the first ultra hard material layer. In yet another exemplary embodiment, the second ultra hard material layer is formed over only a portion of the first ultra hard material layer. In yet a further exemplary embodiment, the first ultra hard material layer has an upper surface and a peripheral surface having a height and the second ultra hard material layer covers between 50% to 100% of the height of the peripheral surface. In a further exemplary embodiment, the thickness of the second ultra hard material layer is not constant. In one exemplary embodiment, a surface of the second ultra hard material layer interfacing with the first ultra hard material layer is non-uniform. In another exemplary embodiment, the first ultra hard material layer has a non-uniform outer surface. In yet another exemplary embodiment, the first and second ultra hard material layers include the same type of ultra hard material In a further exemplary embodiment, the first ultra hard material layer has a depression and the second ultra hard material layer is positioned within the depression. In an exemplary embodiment, the second ultra hard material layer defines a cutting edge of the cutting element to be used for cutting. In yet a further exemplary embodiment, the cutting element further includes a third ultra hard material layer formed over the first ultra hard material layer and spaced apart from the second ultra hard material layer. The third ultra hard material layer has a thickness in the range of 0.05 mm to 2 mm. In yet a further exemplary embodiment, as the second ultra hard material wears it forms a scar exposing the first ultra hard material layer and the second ultra hard material layer defines at least a lip having a sharp edge surrounding said scar. The first ultra hard material layer wears faster than the second ultra hard material layer In another exemplary embodiment, a drill bit is provided having a body and any of the aforementioned exemplary embodiment cutting element mounted on its body. In a further exemplary embodiment a drill bit is provided having a body and a cutting element mounted on the body. The cutting element includes a substrate and a cutting layer formed over the substrate. The cutting layer includes a first ultra hard material layer formed over the substrate, and a second ultra hard material layer formed over the first ultra hard material layer. The second ultra hard material layer has a thickness in the range of 0.05 mm to 2 mm and is oriented for making contact with an object to be drilled by the bit. In yet another exemplary embodiment, the cutting element cutting layer further includes a third ultra hard material layer formed over the first ultra hard material layer and spaced apart from the second ultra hard material layer. This third ultra hard material layer has a thickness in the range of 0.05 mm to 2 mm. In yet a further exemplary embodiment, the cutting element cutting layer second ultra hard material layer covers the entire first ultra hard material layer.

In another exemplary embodiment, a method for improving the cutting efficiency of a cutting layer is provided. The method includes forming a cutting element having a substrate, a first ultra hard material layer over the substrate and a second ultra hard material layer over the first ultra hard material layer such that the second ultra hard material layer has a thickness in the range of 0.05 mm to 2 mm. The first ultra hard material layer wears faster than the second ultra hard material layer, and the first and second ultra hard material layers define the cutting layer. The method further includes cutting an object with the cutting layer wearing a portion of the second ultra hard material layer exposing a portion of the first ultra hard material layer defining a wear scar exposing the first ultra hard material layer surrounded by the second ultra hard material layer. The method also includes continuing cutting the object with the cutting layer causing the inner layer to wear faster than the outer layer forming at least a lip on the outer layer having a cutting edge surrounding the wear scar. In another exemplary embodiment, the scar has an area that increases after continuous cutting with the cutting layer.

DETAILED DESCRIPTION OF THE INVENTION

Figure 1:
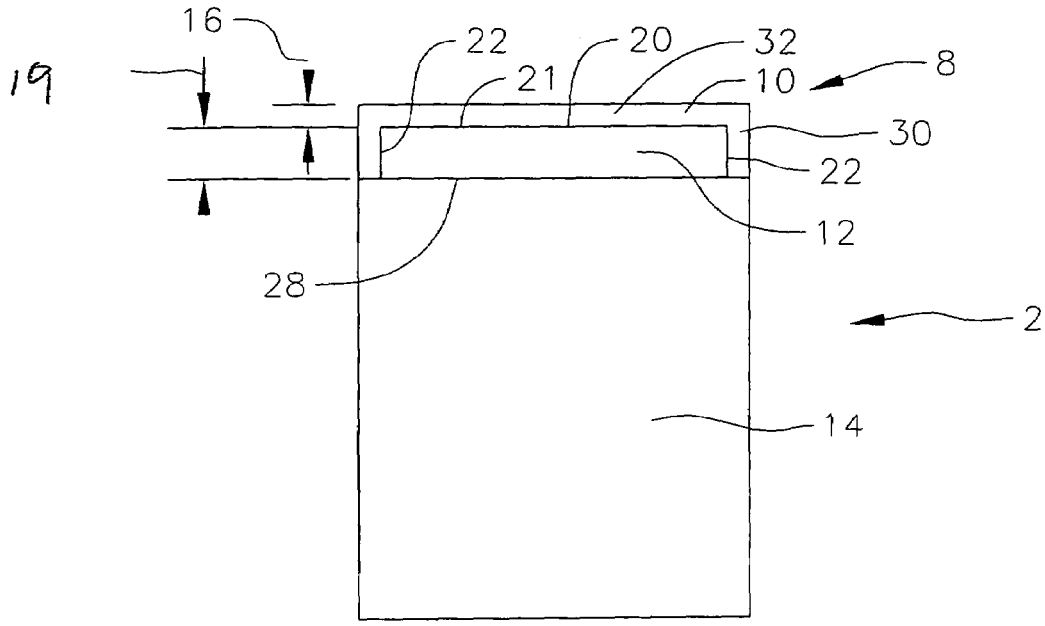
FIGS. 1-4 are cross-sectional views of exemplary embodiment cutting elements of the present invention.

To improve the abrasion resistance, strength and fracture toughness of cutting layers of exemplary embodiment cutting elements 2 of the present invention, the inventive cutting layers 8 incorporate an outer ultra hard material layer 10 formed over an inner ultra hard material layer 12, both of which are formed over a substrate 14, as for example shown in FIG. 1. The term "substrate" as used herein means any substrate over which is formed the ultra hard material layer. For example a "substrate" as used herein may be a transition layer formed over another substrate. Moreover, the terms "upper" and "lower" as used herein are relative terms to denote the relative position between two objects and not the exact position of two objects. For example an upper object may be lower than a lower object.

In one exemplary embodiment, the outer ultra hard material layer 10 has a higher abrasion strength than the inner ultra hard material layer 12. In another exemplary embodiment, the outer ultra hard material layer 10 is formed from ultra hard material particles, such as diamond or CBN particles, which are finer than the ultra hard material particles forming the inner layer 12. In this exemplary embodiment, the ultra hard material particles forming the outer layer have a average particle size smaller than the average particle size of the ultra hard material particles forming the inner layer. In yet a further exemplary embodiment, the outer ultra hard material layer 10 is formed from an ultra hard material layer having a higher thermal resistance than the inner layer. For example the outer layer may be a TSP material, whereas the inner layer may be a PCD layer. With either of the exemplary embodiments, the outer layer is relatively thin. In an exemplary embodiment, the outer layer has a thickness 16 in the range of about 0.05 mm to about 2 mm.

In an exemplary embodiment, the outer layer 10 may cover the entire outer surface 20 of the inner layer 12 as for example shown in FIG. 1. In the exemplary embodiment shown in FIG. 1, the outer surface 20 of the inner layer 12 includes an upper surface 21 and a peripheral surface 22 surrounding the upper surface 21. In another exemplary embodiment, the outer layer 10 may cover only a portion of the outer surface 20 of the inner layer 12, as for example shown in FIG. 2. In an exemplary embodiment, the outer layer covers a portion of the inner layer and is positioned such that the outer layer will make contact with the object being cut during cutting. Typically the outer layer forms the edge of the cutting layer, such as edge 15 shown in FIG. 2, that will be used to cut an object. In one exemplary embodiment, the outer layer extends over at least a portion of the upper surface 21 of the inner layer 12 and at least over a portion of the peripheral surface 22 of the inner layer. In an exemplary embodiment, the outer layer extends over the peripheral surface of the inner layer and covers between 50% and 100% of the height 19 of the peripheral surface as measured from the upper surface 21 of the inner layer 12, as for example shown in FIGS. 2 and 3. In yet a further exemplary embodiment, the outer layer may extend over the entire upper surface of the inner layer. In yet a further exemplary embodiment, the outer layer may encapsulate the entire inner layer as for example shown in FIG. 1.

Figure 2:
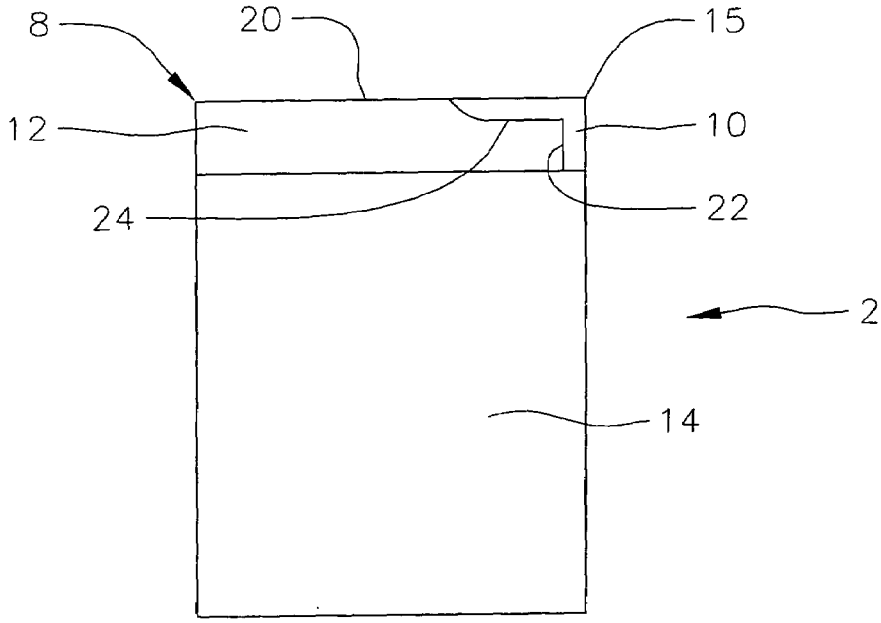
Figure 3:
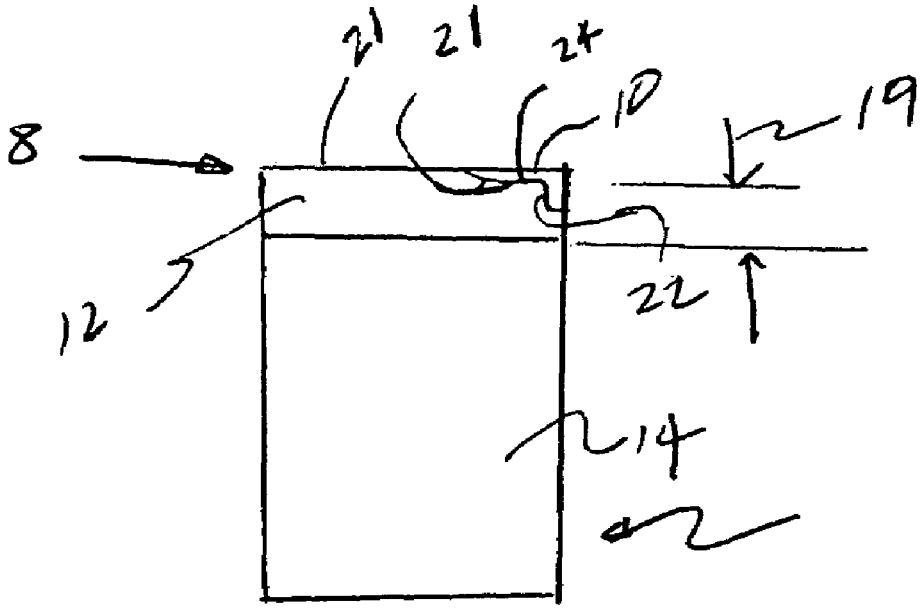
Figure 4:
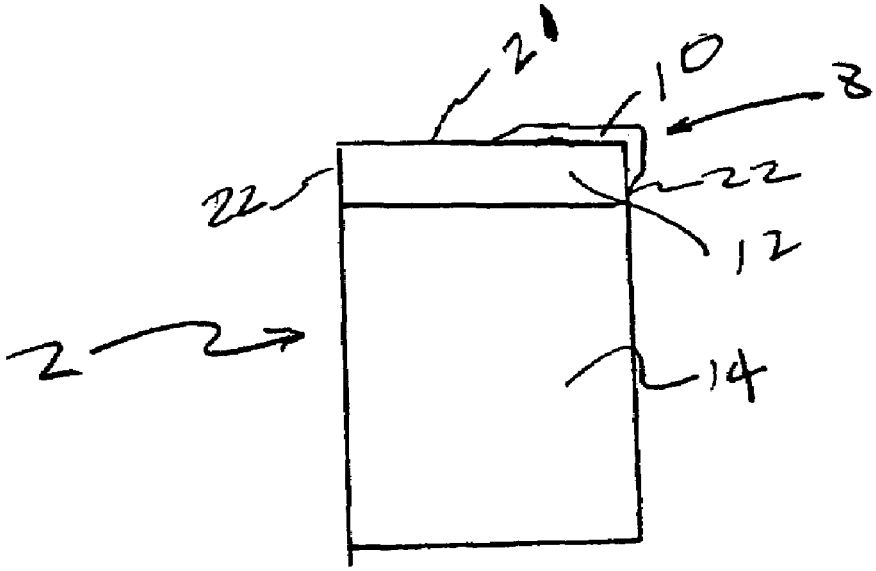

In the exemplary embodiments, shown in FIGS. 2 and 3, the inner layer forms a recess 24 to accommodate the outer layer 10, so that an outer surface 26 of the outer layer is flush with the upper surface 21 and/or the peripheral surface 22 of the inner layer. In other exemplary embodiments, the inner layer may not have a recess, or may not have as deep a recess, as shown in FIGS. 2 and 3, and the outer layer 10 may not be flush with the upper surface 21 and/or the peripheral surface 22 of the inner layer 12, as for example shown in FIG. 4.

Figure 5:
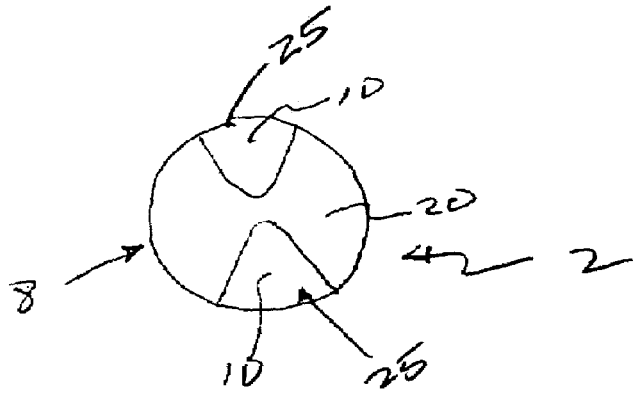
FIG. 5 is a top view of an exemplary embodiment cutting element of the present invention.

In other exemplary embodiments, multiple outer layers may be formed over multiple sections 25 of the inner layer, as for example shown in FIG. 5. These sections may be opposite each other, as for example shown in FIG. 5. In this regard, as an outer layer wears, the cutting element may be rotated relative to a bit body such that the other outer layer is used to do the cutting.

Figure 6A:
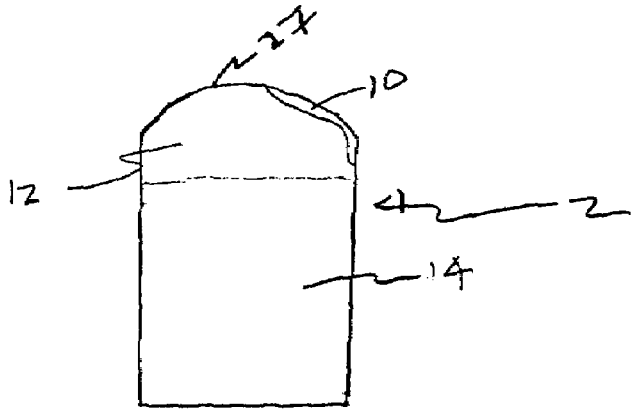
FIGS. 6A, 6B and 7-11 are cross-sectional views of other exemplary embodiment cutting elements of the present invention.
Figure 6B:
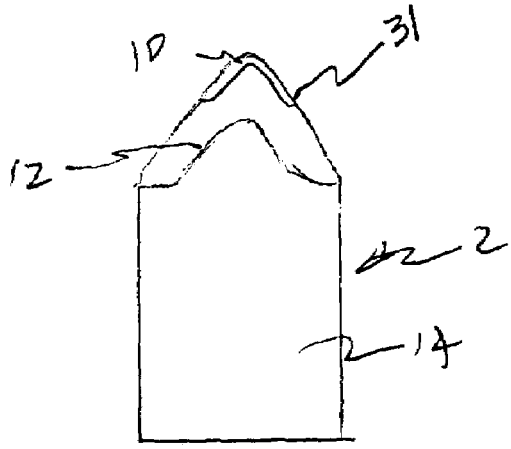

In other exemplary embodiments, the outer layer 10 may be formed over an inner layer 12 which has a dome-shaped outer surface 27, as for example shown in FIG. 6A, or a saddle shaped outer surface 31 as for example shown in FIG. 6B.

With these embodiments, the outer layers 10 are formed over at least a portion of the inner layers such that the outer layers will make contact with the object to be cut during cutting.

Figure 7:
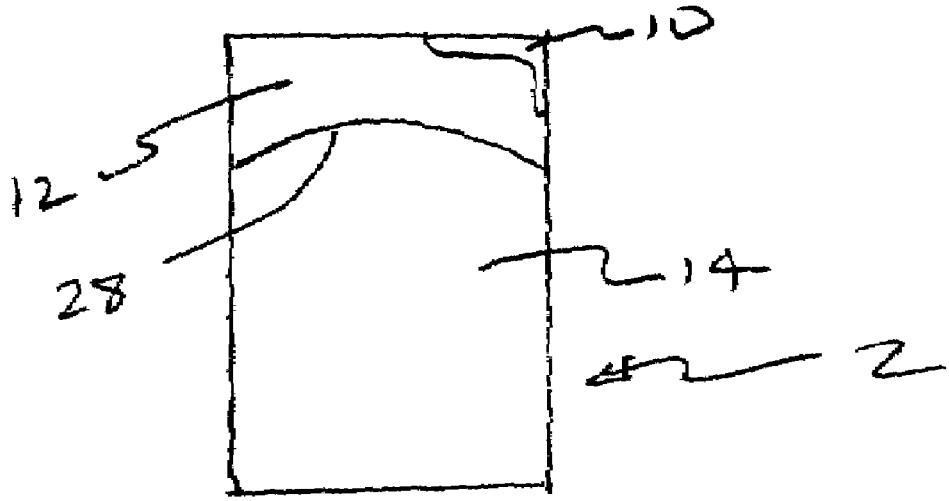
Figure 8:
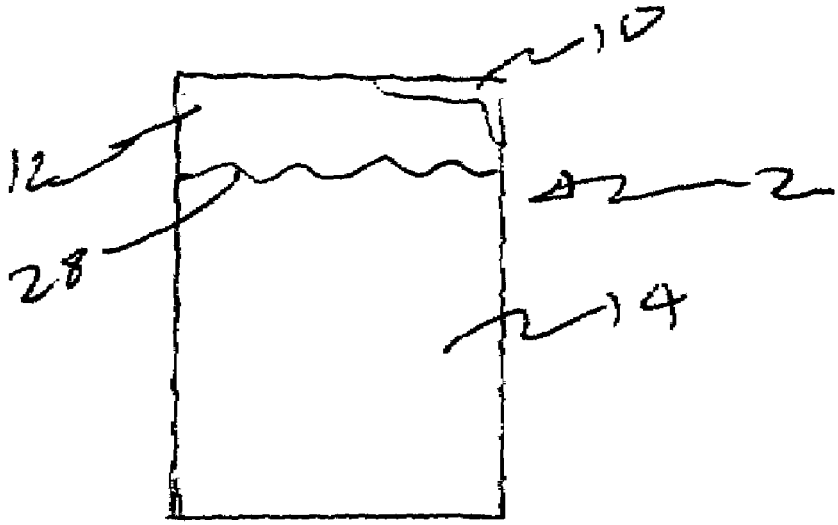
Figure 9:
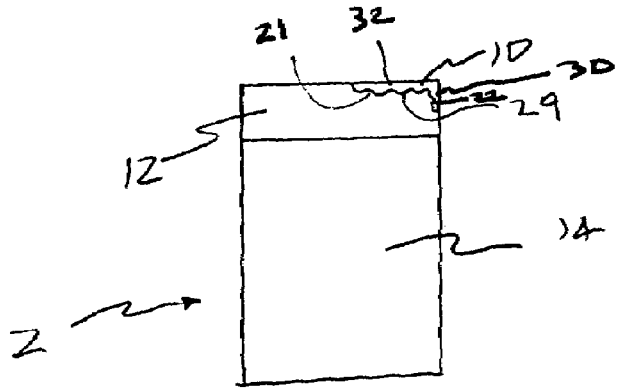

An interface 28 between the inner layer and the substrate may be uniform, e.g., domed, as for example shown in FIG. 7, or flat as shown in FIG. 1, or non-uniform as for example shown in FIG. 8. Furthermore, an interface 29 between the outer layer and the inner layer may also be uniform, or non-uniform, as for example shown in FIG. 9. By using a non-uniform interface, the effects of thermal mismatch between the two layers defining the interface is reduced and the occurrence of straight line laminar cracking that typically occurs along the interface is also reduced.

As used herein, a "uniform" interface is one that is flat or always curves in the same direction. This can be stated differently as an interface having the first derivative of slope always having the same sign. Thus, a domed interface, as for example shown in FIG. 7 is a uniform interface since the center of curvature of all portions of the interface is in or through the carbide substrate. On the other hand, a non-uniform interface is defined as one where the first derivative of slope has changing sign. An example of a non-uniform interface is one that is wavy with alternating peaks and valleys, as for example interface 28 shown in FIG. 8, or interface 29 shown in FIG. 9. Other non-uniform interfaces may have dimples, bumps, ridges (straight or curved) or grooves, or other patterns of raised and lowered regions in relief.

Figure 10:
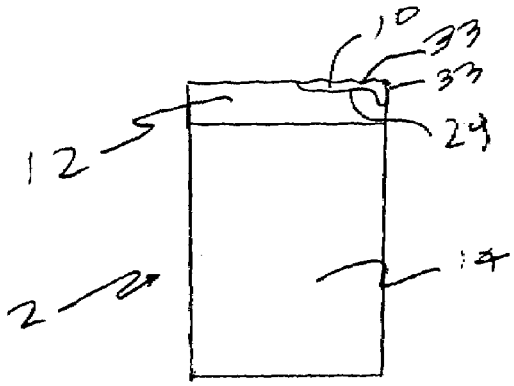
Figure 11:
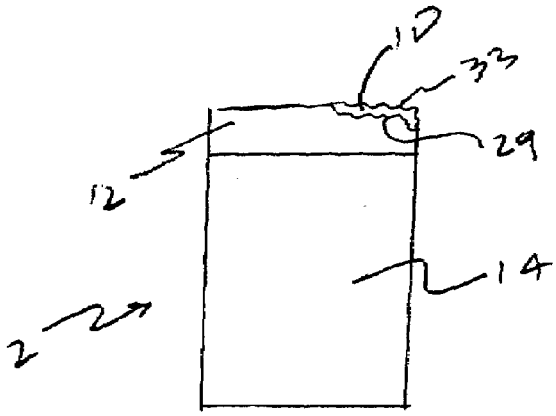

In further exemplary embodiments, the thickness of the outer layer maybe non-uniform. For example, in one exemplary embodiment, a portion 30 of the outer layer formed over the peripheral surface 22 of the inner layer may have a first thickness and a portion 32 of the outer layer formed over the upper surface 21 of the inner layer may have a second thickness different from the first thickness, as for example shown in FIG. 9. In other exemplary embodiments, the thickness of the outer layer may be non-uniform by having the interface surface 29 of the inner layer being non-uniform as for example shown in FIG. 9, by having an outer surface 33 of the outer layer 10 being non-uniform as for example shown in FIG. 10, or by having both the interface surface 29 and the outer surface 33 of the outer layer 10 being non-uniform as for example shown in FIG. 11. In an exemplary embodiment, either of the aforementioned exemplary embodiment outer layers whose thickness is not constant, have a maximum thickness not greater than 2 mm and a minimum thickness not less than 0.05 mm.

Figure 12:
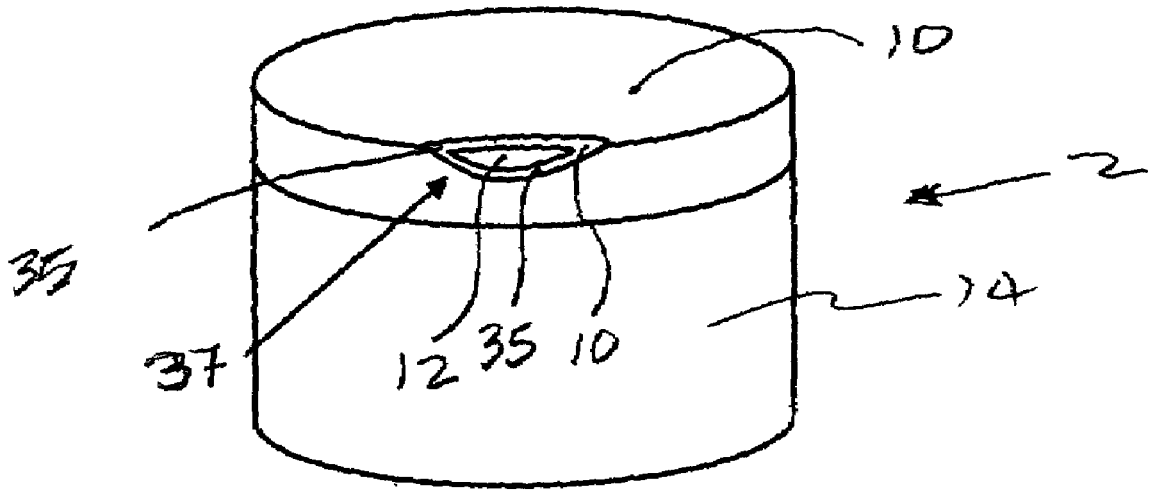
FIG. 12 is a front perspective view of an exemplary embodiment cutting element of the present invention with a portion of its cutting layer worn off.

With the exemplary embodiment cutting elements, when the outer layer wears through, the inner layer gets exposed. As the cutting layer continues to wear during cutting, the inner layer wears faster than the outer layer, thereby causing the outer layer to form a lip or lips 35 having sharp edges surrounding the inner layer defining a wear scar, as for example shown in FIG. 12. These lips improve the cutting efficiency of the cutting layer. By using a thinner outer layer, a smaller wear scar is 37 is generated as the cutting layer wears away than would have otherwise been generated if a thicker outer layer or a single cutting layer had been used. As the outer layer wears away exposing the inner layer, the inner layer will continue to wear faster than the outer layer, reducing friction and thereby reducing the heat generated by such friction. This friction relief and reduction of heat improves the operating life of the cutting layer. Furthermore, wear generates the lip(s) 35 with sharp edges which provide for more aggressive cutting. Applicants have discovered that by using an outer layer having a thickness in the range of 0.05 mm to 2 mm, the lip(s) 35 form have a sufficient thickness to withstand the cutting loads that they are exposed to during cutting for a sufficient period of time. In this regard, the thickness of the lips do not become a detriment to the operating life of the cutting layer.

Furthermore, the outer layer, when formed from a finer average particle size ultra hard material than the inner layer, has a higher abrasion resistance and higher strength than the inner layer, while the inner layer has better fracture toughness than the outer layer. In this regard, the outer layer due to its higher abrasion resistance will have increased resistance to crack-growth initiation. If a crack were to initiate on the outer layer and progress to the inner layer, the inner layer due to its increased fracture toughness will provided increased resistance to the crack's growth.

Figure 13A:
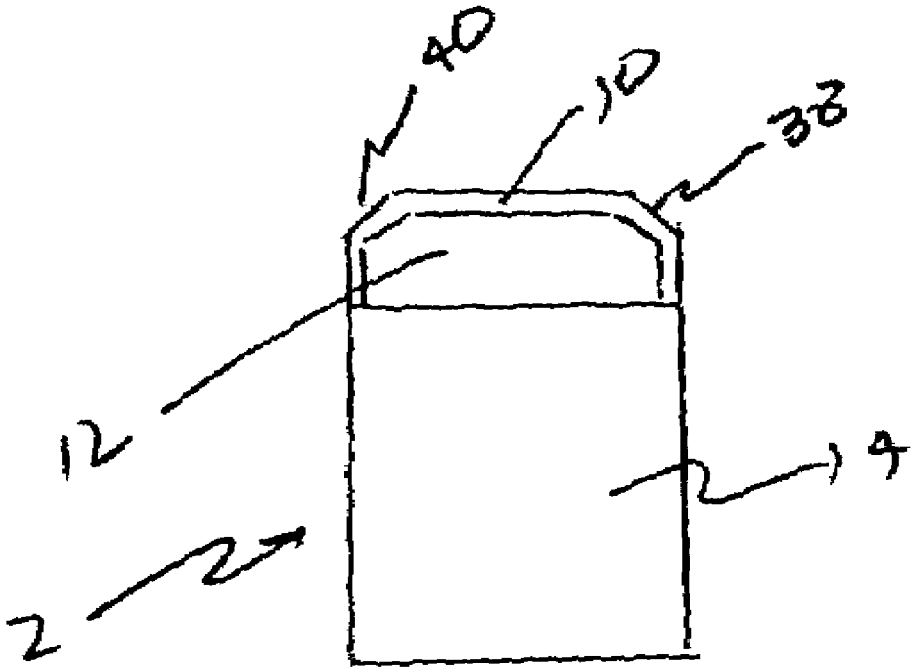
FIGS. 13A and 13B are cross-sectional views of other exemplary embodiment cutting elements of the present invention.
Figure 13B:
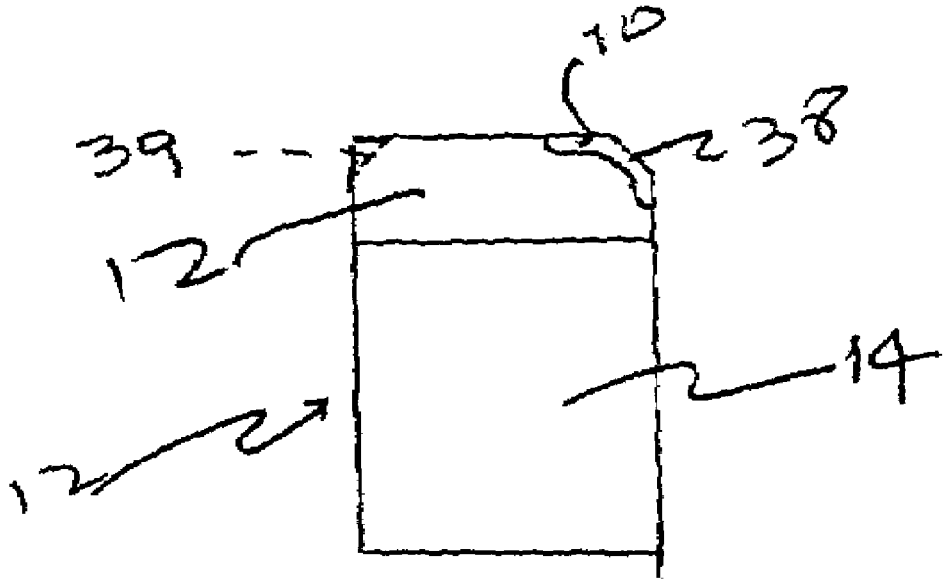

Furthermore, with any of the aforementioned exemplary embodiments, the cutting edges of the cutting elements may be chamfered, as for example chamfered cutting edges 38 defined by outer layers 10 as shown in FIGS. 13A and 13B. In other exemplary embodiments, a chamfered edge may be defined on a portion of the inner layer 12 that is not covered by an outer layer, such as chamfered edge 39 shown with dashed lines in FIG. 13B. Although these exemplary embodiment chamfered edges are shown as single chamfered edges, in other exemplary embodiment, these edges may be multiple chamfered, as for example double chamfered. The benefits of chamfered edges are known in the art.

By using an inner ultra hard material layer having coarser ultra hard material particles, i.e., having a coarser average particle size, the present invention is able to incorporate a finer particle ultra hard material outer layer on a cutting element, without generating the higher residual stresses that are generated when a finer particle ultra hard material layer is formed directly over a tungsten carbide substrate. The higher residual stresses may cause early failure of the cutting element. These higher residual stresses are due to a higher volumetric change, caused by the sintering process, between the finer particle ultra hard material layer and the substrate than between the coarser particle ultra hard material layer and the substrate. By incorporating a coarser particle ultra hard material layer as the inner layer, and by using a relatively finer particle ultra hard material outer layer, the inner layer acts as a transition layer reducing the magnitude of the residual stresses that are generated on the overall cutting layer (the combination of the inner and outer layers).

Figure 14:
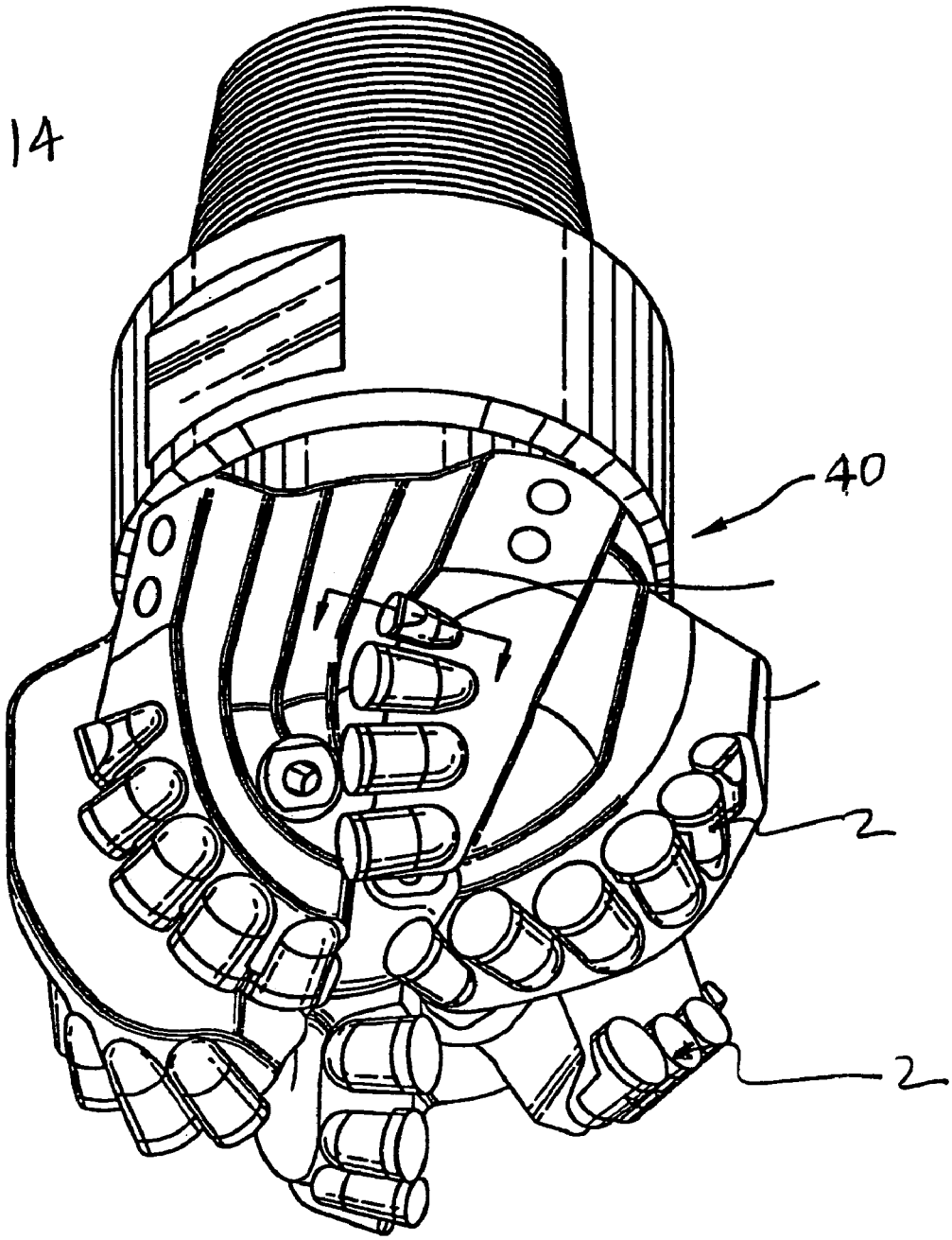
FIG. 14 is a perspective view of a bit incorporating cutting elements of the present invention mounted thereon.

Any of the exemplary embodiments may be mounted on a bit body such as bit body 40 shown in FIG. 14.

To form the exemplary embodiment cutting elements, a layer of ultra hard material that is used to form the outer layer may be placed inside a refractory metal enclosure used for sintering followed by another layer of the ultra hard material that is used to form the inner layer, followed by a substrate. The entire assembly of the two layers of ultra hard material particles and substrate is then sintered at a sufficient temperature and pressure to form a cutting element of the present invention. In one exemplary embodiment, the material used to form the inner layer and/or the material used to form the outer layer may be in powder form. In other exemplary embodiments, the material used to form the inner layer and/or the material used to form the outer layer may be in tape form. A tape material is typically formed by mixing ultra hard material powder with a binder. The tape is placed in the enclosure in lieu of the powder.

The shapes of the ultra hard material layers may also be defined in the enclosure by using known techniques. The powder used to form any of the ultra hard material layers may, for example, be shaped using a stamp, a mold or other known means. A binder, such as a wax or a mineral oil, may be added to the powder to help the powder hold a desired shape. In this regard, the powder may be shaped to have a desired shape prior to sintering.

In one exemplary embodiment, the material used to form the outer layer has an average particle size that is smaller than the average particle size of the material used to form the inner layer. In another exemplary embodiment, the material used to form the outer layer is chosen such that the outer layer has better abrasion resistance than the inner layer. In another exemplary embodiment, the material chosen to form the outer layer has better thermal resistance than the material used to form the inner layer. This may be accomplished by leaching the binder from the outer layer after it is formed or by forming the outer layer with a silicon carbide binder. In a further exemplary embodiment, the outer layer and at least a portion of the inner layer are leached. In yet another exemplary embodiment, the same material is used to form the inner and the outer layer. This may be accomplished by forming a single layer of ultra hard material. After formation, a portion of the ultra hard material is leached to define the outer layer. The leached portion defining the outer layer, in an exemplary embodiment, has thickness in the range of 0.05 mm to 2 mm. In this regard, the outer layer is a TSP material layer. In an exemplary embodiment the outer layer includes the same type of ultra hard material particles as the inner layer, i.e., both layers are formed from the same type of ultra hard material. For example both layers may include diamond, or both layers may include cubic boron nitride.

Although the present invention has been described and illustrated to respect to multiple embodiments thereof, it is to be understood that it is not to be so limited, since changes and modifications may be made therein which are within the full intended scope of this invention as hereinafter claimed.

What is claimed is:

1. A cutting element comprising:

a substrate;

a first ultra hard material layer formed over the substrate, said first ultra hard material comprising a first surface and a peripheral surface extending from adjacent the substrate to the first surface; and a second ultra hard material layer formed over the first ultra hard material layer, wherein the second ultra hard material layer has a thickness in the range of 0.05 mm to 2 mm, wherein said second ultra hard material layer is formed over at least a portion of said first ultra hard material layer first surface and over at least a portion of said first ultra hard material peripheral surface.

2. A cutting element as recited in claim 1 wherein the second ultra hard material layer has a higher abrasion resistance than an first ultra hard material layer.

3. A cutting element as recited in claim 1 wherein the second ultra hard material layer comprises an average ultra hard material particle size that is smaller than an average ultra hard material particle size of the first ultra hard material layer.

4. A cutting element as recited in claim 1 wherein the second ultra hard material layer is a TSP material layer.

5. A cutting element as recited in claim 1 wherein the second ultra hard material layer is a PCD material layer.

6. The cutting element as recited in claim 5 wherein the first ultra hard material layer is a PCD material layer.

7. A cutting element as recited in claim 1 wherein the second ultra hard material layer is a PCBN material layer.

8. A cutting element as recited in claim 1 wherein the second ultra hard material layer encapsulates the first ultra hard material layer.

9. A cutting element as recited in claim 1 wherein the second ultra hard material layer is formed over only a portion of the first ultra hard material layer.

10. A cutting element as recited in claim 1 wherein the peripheral surface has a height and wherein the second ultra hard material layer covers between 50% to 100% of the height of the peripheral surface.

11. A cutting element as recited in claim 10 wherein the second ultra hard material layer covers the entire height of the peripheral surface.

12. A cutting element as recited in claim 1 wherein the thickness of the second ultra hard material layer is not constant.

13. A cutting element as recited in claim 1 wherein a surface of the second ultra hard material layer interfacing with the first ultra hard material layer is non-uniform.

14. A cutting element as recited in claim 1 wherein the first and second ultra hard material layers comprise the same type of ultra hard material.

15. A cutting element as recited in claim 1 wherein the first and second ultra hard material layers are different types of ultra hard material layers.

16. A cutting element as recited in claim 1 wherein the first ultra hard material layer comprises a non-uniform outer surface.

17. A cutting element as recited in claim 1 wherein the first ultra hard material layer comprises a depression and wherein the second ultra hard material layer is within the depression.

18. A cutting element as recited in claim 1 further comprising a third ultra hard material layer formed over the first ultra hard material layer and spaced apart from the second ultra hard material layer, wherein the third ultra hard material layer has a thickness in the range of 0.05 mm to 2 mm.

19. A cutting element as recited in claim 1 wherein the second ultra hard material layer defines a cutting edge of the cutting element to be used for cutting.

20. A cutting element as recited in claim 1 wherein when the second ultra hard material layer wears it forms a scar exposing a portion of the first ultra hard material layer and a portion of said second ultra hard material layer completely surrounding said portion of the first ultra hard material layer, wherein said second ultra hard material layer portion defines a lip having a sharp edge, wherein the first ultra hard material layer wears faster than the second ultra hard material layer.

21. A bit comprising a body and a cutting element as recited in claim 1 mounted on said body.

22. The cutting element as recited in claim 1 wherein the second ultra hard material layer comprises an edge between said portion formed over said first surface and said portion formed over said peripheral surface.

23. The cutting element as recited in claim 1 wherein the second ultra hard material layer abuts the substrate.

24. A bit comprising:

a body; and a cutting element mounted on the body, the cutting element comprising, a substrate, and a cutting layer formed over the substrate, the cutting layer comprising, a first ultra hard material layer formed over the substrate, said first ultra hard material comprising a first surface and a peripheral surface extending from adjacent the substrate to the first surface, and a second ultra hard material layer formed over the first ultra hard material layer, wherein the second ultra hard material layer has a thickness in the range of 0.05 mm to 2 mm, wherein said second ultra hard material layer is formed over at least a portion of said first ultra hard material layer first surface and over at least a portion of said first ultra hard material peripheral surface, and wherein said second ultra hard material layer is oriented for making contact with an object to be drilled by said bit.

25. A drill bit as recited in claim 24 wherein the cutting element cutting layer further comprises a third ultra hard material layer formed over the first ultra hard material layer and spaced apart from the second ultra hard material layer, wherein the third ultra hard material layer has a thickness in the range of 0.05 mm to 2 mm.

26. A drill bit as recited in claim 24 wherein the second ultra hard material layer covers the entire first ultra hard material layer.

27. A method for improving the cutting efficiency of a cutting layer comprising;

forming a cutting element having a substrate, a first ultra hard material layer over the substrate and a second ultra hard material layer over the first ultra hard material layer, wherein the second ultra hard material layer has a thickness in the range of 0.05 mm to 2 mm, wherein the first ultra hard material layer wears faster than the second ultra hard material layer, wherein said first and second ultra hard material layers define the cutting layer;

cutting an object with said cutting layer wearing a portion of the second ultra hard material layer exposing a portion of the first ultra hard material layer surrounded by a portion of the second ultra hard material layer defining a wear scar; and continuing cutting said object with said cutting layer causing the first ultra hard material layer exposed portion to wear faster than the portion of the second ultra hard material layer causing said worn portion of the second ultra hard material layer to form a lip having a cutting edge, said lip completely surrounding the worn exposed portion of the first ultra hard material layer.

28. The method as recited in claim 27 wherein the scar comprises an area that increases after continuous cutting with said cutting layer.

29. A cutting element comprising:

a substrate;

a first ultra hard material layer formed over the substrate; and a second ultra hard material layer formed over the first ultra hard material layer, wherein the second ultra hard material layer has a thickness in the range of 0.05 mm to 2 mm, wherein a surface of the second ultra hard material layer interfacing with the first ultra hard material layer is non-uniform.

30. A cutting element comprising:

a substrate;

a first ultra hard material layer formed over the substrate; and a second ultra hard material layer formed over the first ultra hard material layer, wherein the second ultra hard material layer has a thickness in the range of 0.05 mm to 2 mm, and wherein the first ultra hard material layer comprises a non-uniform outer surface.

31. A cutting element comprising:

a substrate;

a first ultra hard material layer formed over the substrate; and a second ultra hard material layer formed over the first ultra hard material layer, wherein the second ultra hard material layer has a thickness in the range of 0.05 mm to 2 mm, wherein the first ultra hard material layer comprises a depression and wherein the second ultra hard material layer is within the depression.

32. A cutting element comprising:

a substrate;

a first ultra hard material layer formed over the substrate; and a second ultra hard material layer formed over the first ultra hard material layer, wherein the second ultra hard material layer has a thickness in the range of 0.05 mm to 2 mm, wherein when the second ultra hard material layer wears it forms a scar exposing a portion of the first ultra hard material layer completely surrounded by a portion of the second ultra hard material layer, wherein said portion of the second ultra hard material layer defines a lip having a sharp edge, wherein the first ultra hard material layer wears faster than the second ultra hard material layer.

* * * * *